United States Patent [19]

Krekeler

[11] 4,163,581

[45] Aug. 7, 1979

[54] RETAINING MEANS FOR THE CONNECTING PIN WHICH JOINS A BIT HOLDER TO A BASE MEMBER

[75] Inventor: Claude B. Krekeler, Cincinnati, Ohio

[73] Assignee: The Cincinnati Mine Machinery Co., Cincinnati, Ohio

[21] Appl. No.: 793,541

[22] Filed: May 4, 1977

[51] Int. Cl.[2] ..... E21C 35/18

[52] U.S. Cl. ..... 299/91; 37/142 R; 175/413; 299/93

[58] Field of Search ..... 299/91, 93, 92; 175/413; 37/142 R; 85/5 N, 7; 403/154, 316, 317, 378, 379

[56] References Cited

U.S. PATENT DOCUMENTS

| | | | |
|---|---|---|---|
| 2,925,259 | 2/1960 | Brown | 299/92 X |
| 3,152,654 | 10/1964 | Conover | 175/413 X |
| 3,271,080 | 9/1966 | Gowanlock | 299/93 |
| 3,749,449 | 7/1973 | Krekeler | 299/93 |
| 3,869,179 | 3/1975 | Ricca et al. | 403/154 X |

FOREIGN PATENT DOCUMENTS

| | | | |
|---|---|---|---|
| 1066251 | 4/1967 | United Kingdom | 299/91 |
| 1115411 | 5/1968 | United Kingdom | 299/92 |
| 252254 | 2/1970 | U.S.S.R. | 299/93 |

*Primary Examiner*—Stephen J. Novosad
*Assistant Examiner*—Nick A. Nichols, Jr.
*Attorney, Agent, or Firm*—Melville, Strasser, Foster & Hoffman

[57] ABSTRACT

A base member is mounted on the driven element of a mining machine or the like. A bit holder is affixed to the base member in such a way that the bit holder may be readily removed and replaced. The base member and bit holder having cooperating abutment surfaces to sustain much of the resultant cutting forces encountered during operation. A connecting pin is provided to maintain the bit holder in position on the base member. Retaining means are provided for the connecting pin. Such retaining means are located between the ends of the connecting pin so as to lock the connecting pin in position without having to have either the connecting pin or the retaining means extend laterally from the joined bit holder and base member. The connecting pin and its retaining means may readily be removed when it is time to replace the bit holder.

9 Claims, 17 Drawing Figures

RETAINING MEANS FOR THE CONNECTING PIN WHICH JOINS A BIT HOLDER TO A BASE MEMBER

BACKGROUND OF THE INVENTION

1. Field of the Invention:

The invention relates to bit holders and base members for affixing the bit holder to the driven element of a mining machine or the like, and more particularly to bit holders and base members whereby the bit holders may be easily and quickly installed or removed and replaced.

2. Description of the Prior Art:

While the base member of the present invention may be applied to equipment other than mining machines, such as digging machines earthworking machines and the like, for purposes of an exemplary showing it will be described with respect to its use on mining machines.

It has long been recognized that mining cutter bits wear out fast and need frequent replacement. In recent years it has also been recognized that the cutter bit holders wear out quicker than the base members and that it would be desirable to provide means for the ready replacement of such holders. Prior art workers attempted to accomplish this by various types of "pin-on" arrangements. An early example of this is disclosed in U.S. Pat. No. 3,338,634. The pins of these arrangements, however, bore substantially all of the resultant cutting forces and were subject to wear and failure. This problem was solved by the invention disclosed in U.S. Pat. No. Re. 28,310 wherein the bit holder and base member, although joined by a connecting pin, were also provided with cooperating abutment surfaces which sustained a good portion of the resultant cutting forces encountered during mining operations. In most of the arrangements of the last mentioned patent, however, the connecting pin extended laterally beyond the edges of the joined bit holder and base member, and the retaining means for such connecting pin were also located beyond the sides of the joined members. Such arrangement required more space and created interference during mining operations.

The present invention eliminates the need for either the connecting pin or its retaining means to be laterally offset from the joined bit holder and base member.

The invention is particularly well suited for use with bit holders and base members of the type shown in FIGS. 1 through 10 of U.S. Pat. No. Re. 28,310 and various of the arrangements depicted in U.S. Pat. No. 3,397,012; for bit holders and base members of the type shown in FIGS. 11 and 14 of U.S. Pat. No. Re. 28,310 and U.S. Pat. No. 3,519,309; for the bit holder and base member of FIG. 12 of U.S. Pat. No. Re. 28,310 and the combinations possible stemming from the combined teachings of U.S. Pat. Nos. 3,397,012 and 3,519,309; and for the bit holder and base member of FIG. 13 of U.S. Pat. No. Re. 28,310 and for various of the arrangements of U.S. Pat. No. 2,965,365.

It should also be noted, however, that the foregoing patents are mentioned only as being exemplary of the art to which the instant invention may be applied. Other prior art patents disclosing additional bit systems to which this invention may be applied are U.S. Pat. Nos. 3,622,206 and 3,841,703.

Furthermore, there is additional prior art which may be pertinent to certain forms of this invention. Attention is called, for example, to the following group of U.S. Pat. Nos. 2,623,398; 2,766,979; 2,802,368 and 2,802,369.

Other pertinent U.S. Pats. are Nos. 2,741,139 and No. 2,826,085. These latter patents disclose other combinations in which D-shaped members have been employed, although not in the various combinations of bit holders and base members to which this invention is directed.

SUMMARY OF THE INVENTION

It is contemplated that a base member may be permanently affixed to the driven element of a mining machine. A removable connecting pin joins the bit holder to the base member in such manner that upon removal of the connecting pin the bit holder may readily be itself removed from the base member and quickly replaced. Such bit holder and base member, however, are, in accordance with the teachings of U.S. Pat. No. Re. 28,310, provided with cooperating abutment surfaces which relieve the connecting pin of much of the resultant cutting forces encountered during mining operations. By virtue of the instant invention retaining means are provided for the connecting pin and are located within the confines of the joined bit holder and base member so that neither the connecting pin nor the retaining means therefore need extend laterally beyond the sides of the joined members.

The bit holder and base member have interlocking portions which are provided with aligned bores to just nicely receive the connecting pin. One of such portions is provided with a bore which extends from a face thereof to its connecting pin receiving bore. The connecting pin is provided with, in one embodiment, a bore therein at right angles to the axis thereof to be brought into alignment with that bore which extends inwardly from the face of one of the interlocked portions. A suitable retaining means is then placed within these last mentioned aligned bores whereby to hold the connecting pin in position. In such embodiment the retaining means may be a pin which has a press fit within the aligned bores.

In another embodiment of the invention the connecting pin may be provided with an annular groove which may be brought into alignment with the retaining means bore in one of the joined portions and located so that a retaining pin driven through the retaining means bore will be engaged within such annular groove.

In a further embodiment of the invention the last mentioned annular groove may be provided with a flat which may be engaged by a set screw located within the retaining means receiving bore of the appropriate bit holder or base member portion.

In yet another embodiment of the invention the retaining means receiving bore which extended from a face of an appropriate portion of the bit holder or base member in the previously described embodiments is eliminated, and the connecting pin is modified so as to be provided with a flat from which extend one or more longitudinal grooves to receive pins which may be driven thereinto from the end of the connecting pin. In this last mentioned embodiment one of the joined portions of the bit holder and base member is provided with a bore of the same cross sectional configuration as the modified connecting pin and the other of such portions is provided with an enlarged bore or area. The connecting pin is provided with means by which the retaining pin, when driven into the groove provided for it in the connecting pin, is deformed so as to extend into the enlarged area whereby to retain the connecting pin within the joined portions.

A further embodiment of the invention also utilizes what is basically a connecting pin which is D-shaped in cross section. The flat side of the pin is provided with deformable or resilient means which may extend therefrom. One of said base member and said bit holder is provided with a D-shaped perforation to receive the D-shaped connecting pin and the other of said members provides an enlarged locking area such as may be provided by a full circular perforation therein. The connecting pin and its resilient means are forced through the D-shaped perforation whereafter a portion of the resilient means expands into the enlarged locking area to retain the connecting pin in that portion whereby it joins the bit holder to the base member.

In all of the embodiments of this invention, therefore, the connecting pin which joins interlocked portions of the bit holder and base member is retained therein by retaining means so located that neither the connecting pin nor such retaining means need extend laterally beyond the sides of the joined portions.

BRIEF DESCRIPTION OF THE DRAWINGS

FIG. 1 is a side elevation of a bit holder and base member joined by a connecting pin which is retained by the retaining means of one embodiment of this invention, only a fragment of the driven element of the mining machine to which the base member is fastened being illustrated.

FIG. 2 is a front elevation of the arrangement of FIG. 1.

DESCRIPTION OF THE PREFERRED EMBODIMENTS

Figure 8:
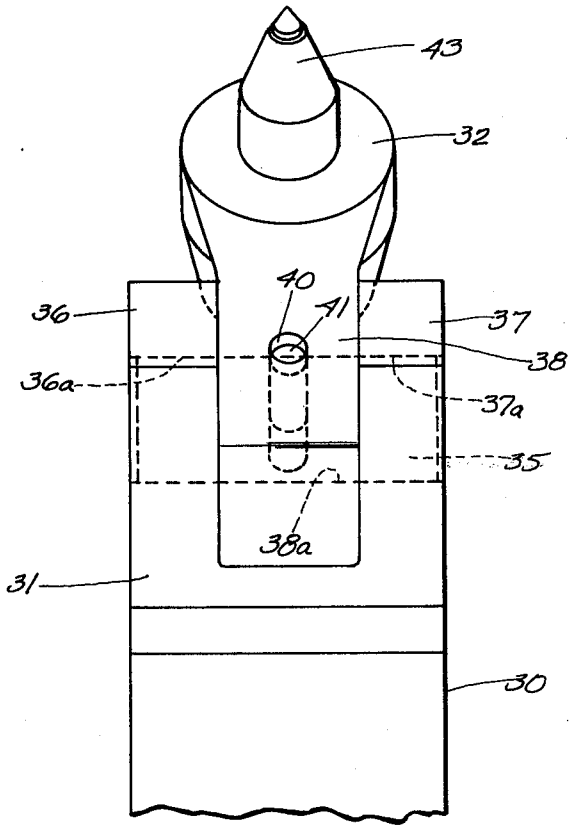
FIG. 8 is a side elevation of another modification of the retaining means for retaining the connecting pin which joins the bit holder and base member.

Referring first to FIGS. 1 and 2, one embodiment of the instant invention is depicted as applied to a bit holder and base member, and connecting pin, of the type generally illustrated in FIGS. 1 through 10 of U.S. Pat. No. Re. 28,310 and in various of the FIGS. of U.S. Pat. No. 3,397,012. Such arrangements are, however, exemplary only and it will be understood by those skilled in the art, and as represented by the additional modifications shown and described herein, that the invention may be applied to other types of bit holders and base members and connecting pins therefor.

The driven element of a mining machine and the like is fragmentarily indicated at 30. The base member 31 may be permanently affixed to the driven element 30 as by welding and the like, or by other ways customary in the industry. The bit holder is indicated at 32. The base member 31 and bit holder 32 have cooperating abutment surfaces 33 and 34 respectively to sustain much of the resultant cutting forces encountered during mining operations. These members 31 and 32 are joined by a connecting pin 35.

In the arrangement of these FIGS. 1 and 2 the base member 31 is illustrated as being a block-like element having a pair of upstanding bifurcations 36 and 37. The bit holder 32 has a portion 38 thereof which is received between the bifurcations 36 and 37. These bifurcations are provided with aligned bores **36*a* and 37*a* to just nicely receive the connecting pin 35. The bit holder portion 38 is also provided with a similar bore 38*a* to receive the connecting pin 35. The relationship among the base member 31, bit holder 32, connecting pin 35 and aligned bores 36*a*, 38*a* and 37*a* is such that when the bit holder portion 38 is placed between the upstanding bifurcations 36 and 37 the cooperating surfaces 33 and 34 will indeed abut one another and the connecting pin 35 may readily be inserted within the aligned bores 36*a*, 38*a*, and 37*a* whereby to join the bit holder 32 to the base member 31**.

The retaining means for the connecting pin 35 of the embodiment of the invention depicted in FIGS. 1 and 2 will now be described. A relatively small bore 39 is provided in the connecting pin 35 at right angles to the axis thereof and extending completely therethrough. A corresponding bore 40 is provided in the portion 38 of the bit holder 32. The bore 40 extends from the front face of the portion 38 to the large bore **38*a* which receives the connecting pin 35. The connecting pin 35 is inserted in the bores 36*a*, 38*a* and 37*a* and the smaller bores 39 and 40 are brought into alignment. A retaining pin 41, having a press or interference fit within at least one of the bores 40 and 39, is then driven into the small bore 40 so that it extends into the small bore 39 of the connecting pin 35. It will be apparent, therefore, that when the retaining pin 41 is in the position shown in FIGS. 1 and 2, the connecting pin 35 will be securely maintained within the orifices 36*a*, 38*a* and 37*a* whereby the bit holder 32 is retained within the base member 31. Preferably the press or interference fit occurs between the retaining pin 41 and the small bore 39 in the connecting pin 35. In some instances, therefore, the small bore 40 may be of a somewhat larger diameter than that of the small bore 39 so as to facilitate insertion and removal of the retaining pin 41**.

When the bit holder 32 becomes worn and it is desired to remove it and replace it with another, the connecting pin 35 of the embodiment of FIGS. 1 and 2 may be removed in one of at least two different manners. It may simply be forcibly driven out of the various bores 36*a*, 38*a* and 37*a*, the retaining pin 41 simply being fractured in the process, whereafter the fragment of retaining pin 41 remaining in the small bore 40 may simply be driven into the bore 38*a* and removed therefrom. Another way of removing the connecting pin 35 is to arrange for the length of the retaining pin 41 to be shorter than the diameter of the connecting pin 35 whereby the pin 41 may be forcibly driven to a position wherein it is completely received within the bore 39 extending through the connecting pin 35, whereafter the connecting pin 35 may be driven from the base member and bit holder.

It is not necessary that the bore 39 extend completely through the connecting pin 35. If, however, it does not extend completely therethrough, the only practical way of removing the connecting pin 35 will be to fracture the retaining pin 41.

Figure 3B:
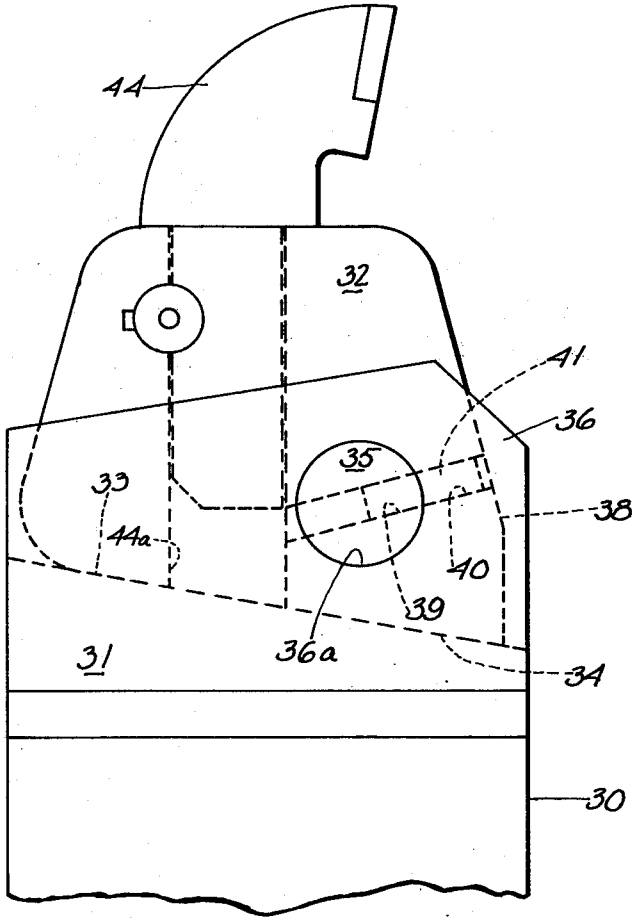
FIG. 3 is a view similar to that of FIG. 1 but depicting the invention as applied to a different style of bit holder and base member.
Figure 13:
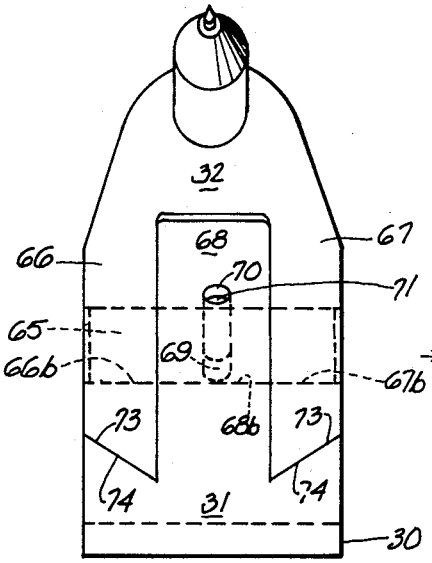
FIG. 13 is a front elevation, similar to that of FIG. 2, showing the invention as applied to an exemplary arrangement wherein the bit holder is bifurcated and the base member extends between the bit holder bifurcations.

Referring now to FIG. 3, the invention is depicted as applied to a base member and bit holder of the type illustrated in FIG. 13 of U.S. Pat. No. Re. 28,310 and in various of the FIGS. of U.S. Pat. No. 2,965,365. It will be apparent, however, that the connecting pin arrangement by which the bit holder is joined to the base member, and the retaining means arrangement of this invention for such connecting pin, are the same as those illustrated in FIGS. 1 and 2 and, therefore, like reference numerals will be employed to designate like parts. The real difference between the depictions of these FIGURES is that the bit 43 is different, and differently secured within its bit holder 32, from the bit 44, and the means for securing it in. The bore 40 is shown in FIG. 3 as extending to the bit perforation or cavity 44*a* to facilitate removal of the pin 41; this, while desirable, is not absolutely necessary—the bore could stop short of such cavity and the connecting pin 35 removed simply by, fracturing the pin 41 or by forcing the pin 41 to a position wherein it is completely within the connecting pin bore 39.

Figure 4A:
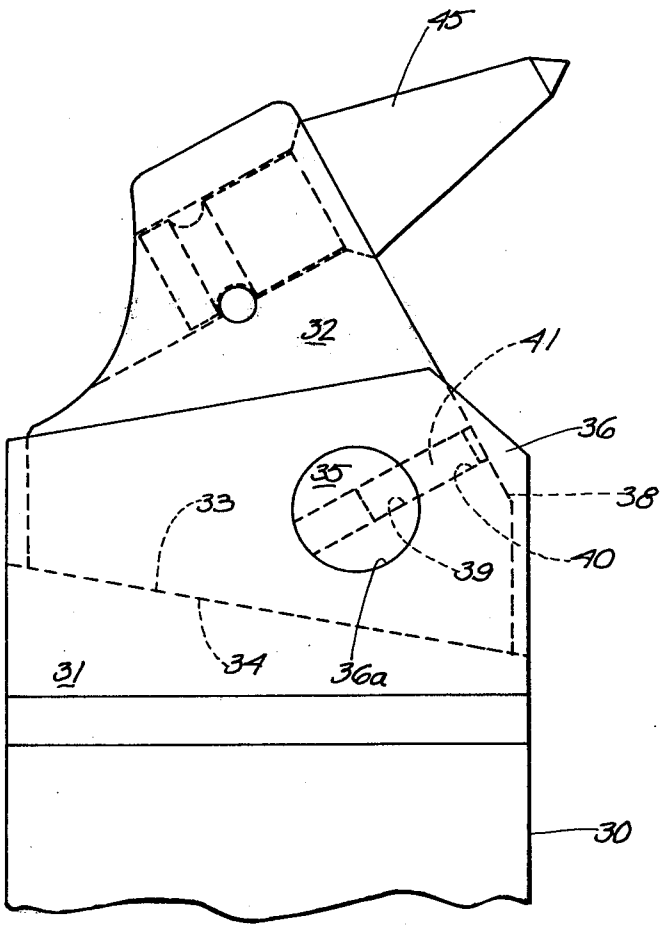
FIG. 4 is a side elevation similar to those of FIGS. 1 and 3 but depicting the invention as applied to yet another style of bit holder and base member.
Figure 11:
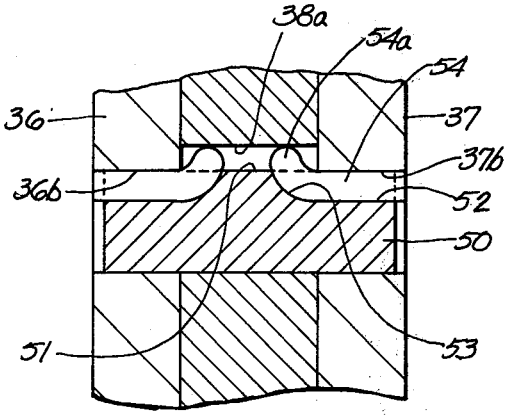
FIG. 11 is a section taken on the line 11—11 of FIG. 10.
Figure 14:
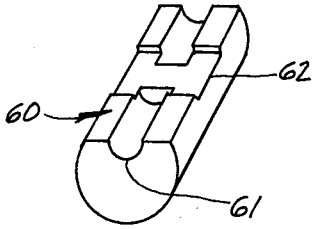
FIG. 14 is a perspective view of yet another modified connecting pin which may be used in the exemplary arrangement of FIG. 16.

In FIG. 4 the invention has been illustrated as used in connection with a bit and bit holder of the type generally depicted in FIGS. 11 and 14 of U.S. Pat. No. Re. 28,310 and in various of the FIGS. of U.S. Pat. No. 3,519,309. As with the arrangement depicted in FIG. 3, the difference in the showing of FIG. 4 lies in the arrangement of the bit 45 and its bit holder 32. Again, therefore, like reference numerals have been employed to designate like parts respecting the invention itself.

These FIGS. 3 and 4 simply illustrate the fact that the instant invention may be applied to base members and bit holders in which a variety of different bits may be retained in their respective bit holders in different ways.

As illustrated in FIG. 13 of the instant application, and as is taught in previously mentioned U.S. Pat. No. Re. 28,310, see for example FIG. 8 of such patent, it is possible to arrange the bit holder and base member combination so that it is the bit holder which is bifurcated, the base member having a portion received between the bit holder bifurcations. Thus, as one example of such a combination, the bit holder 32 of FIG. 13 is provided with bifurcations 66 and 67 while the base member 31 has a portion 68 received therebetween. Much of the resultant cutting forces are sustained by the cooperating abutment surfaces 73 and 74.

When the bit holder 32 is placed on the base member 31 so that the cooperating abutment surfaces 73, 74 are in engagement with one another, the bores 66*b*, 68*b* and 67*b* for the connecting pin 65 will be aligned. The connecting pin 65 is then inserted within these aligned bores. In this embodiment, and others which may be like it, as will be appreciated by those skilled in the art, the retaining means for the connecting pin are located in the base member. Thus the base members portion 68 is provided with a small bore 70 to receive the retaining pin 71 which also extends within the small bore 69 provided in the connecting pin 65.

The various relationships heretofor described in connection with the retaining pin 41 and connecting pin 35, along with the relative diameters and lengths of the small bores 40 and 39, may also be adhered to respecting the corresponding structures and the like depicted in FIG. 13 at 65–71. Preferably, therefore, by way of example, the retaining pin 71 may have a relatively loose fit in the small bore 70 and an interference or press fit in the small bore 69.

Figure 5:
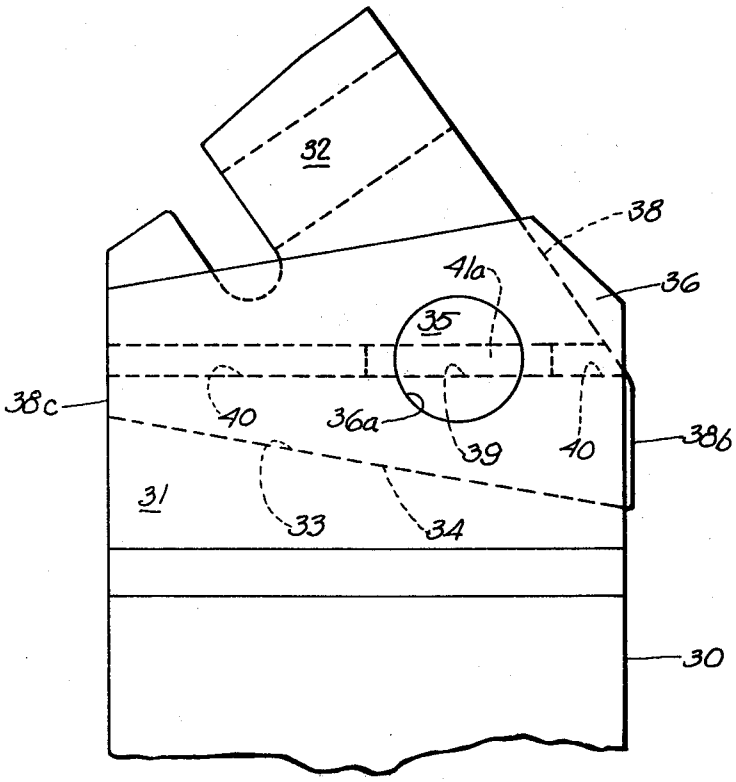
FIG. 5 is a side elevation depicting a modification of the arrangement for retaining the connecting pin which joins the bit holder to the base member.
Figure 8:
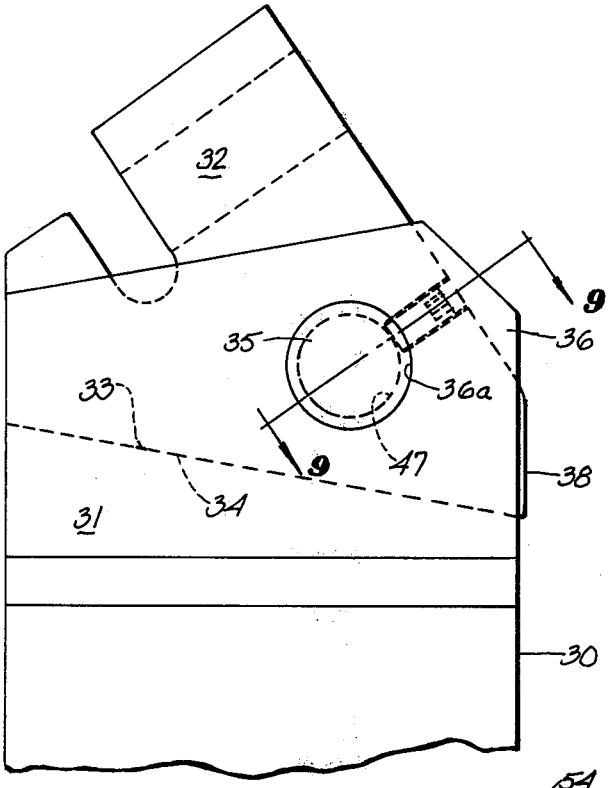

A modification of the invention itself is depicted in FIG. 5. The base member 31 and bit holder 32 are like those illustrated in FIG. 1. Much of the balance of the arrangement of these members and their connecting pin 35 is also the same and, therefore, like reference numerals have again been employed to designate like parts. In the arrangement of FIG. 5, the small bore 40 in the bit holder portion 38 has been located so that it extends completely through the holder portion 38 from the face 38*b* to the face 38*c*. In this arrangement the retaining pin 41*a* is longer than the diameter of the connecting pin 35 and it requires that the small bore 39 in the connecting pin 35 does in fact extend clear through. It is contemplated that the retaining pin 41*a* will have a press or interference fit within at least one of the small bores 40 and 39 and that it will be driven to the position shown in FIG. 5 wherein portions of the retaining pin 41*a* extend to either side of the connecting pin 35. When it becomes necessary to remove the connecting pin 35 this may be done either by applying sufficient pressure axially of the pin 35 to fracture the retaining pin 41*a*, or by simply using a drift and the like to drive the retaining pin 41*a* completely through the small bore 40 of the bit holder portion 38 whereby it may be dislodged at either the face 38*b* or the face 38*c*. In the preferred arrangement the press or interference fit occurs between the retaining pin 41*a* and the small bore 39 in the connecting pin 35; this makes it that much easier to dislodge the retaining pin by driving it out of the bore 39 and thereafter quite easily moving it through the bore 40.

Figure 7:
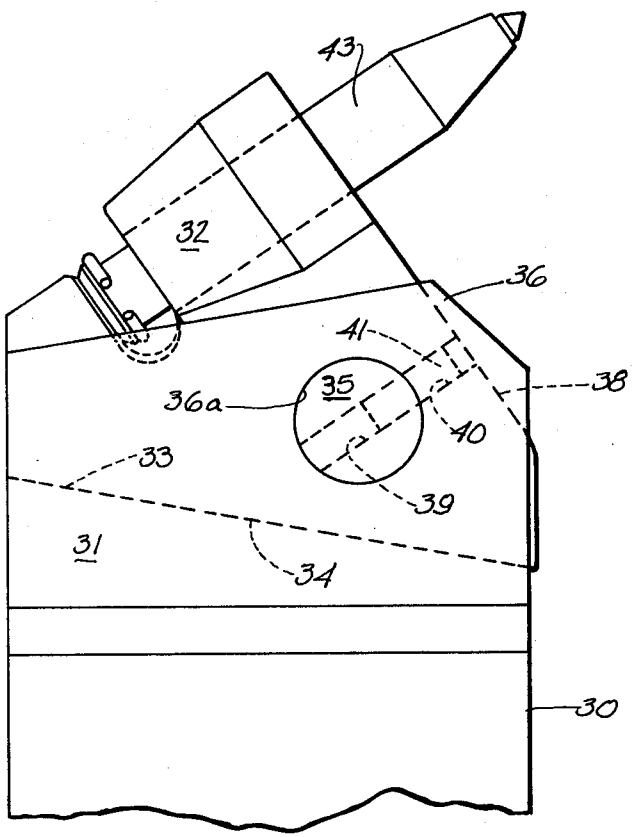
FIG. 7 is a view depicting the modified connecting pin employed in the arrangement of FIG. 6.
Figure 6:
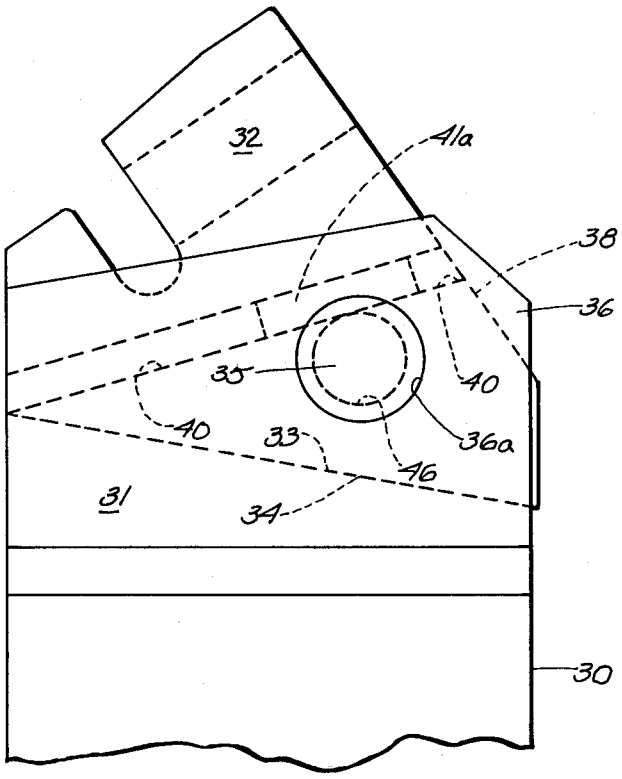
FIG. 6 is a side elevation depicting another modification of the retaining means for retaining the connecting pin which joins the bit holder and base member.
Figure 7:
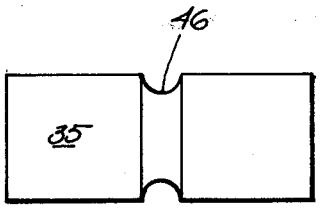

A further modification of the invention is illustrated in FIGS. 6 and 7. In this arrangement the small bore 39 provided in the arrangements of FIGS. 1 through 5 has been eliminated and replaced by an annular groove 46. The base member and bit holder are like those of FIGS. 1, 2 and 5 and like reference numerals will again be employed to designate like parts.

In the FIG. 6 arrangement the small bore 40 is located so that when the groove 46 of the connecting pin 35 is brought into alignment therewith, the retaining pin 41*a*, when driven into the bore 40, will engage within such annular groove 46 whereby to retain the connecting pin 35 in place within the base member portions 36, 37 and bit holder portion 38. The small bore 40 has been illustrated as extending completely through the bit holder portion 38 in the manner illustrated and described in connection with FIG. 5. This makes it relatively easy to remove the retaining pin 41*a* when it is time to remove the connecting pin 35 so that a different bit holder 32 may be secured to the base member 31. The pin 41*a* will have a press or interference fit within either the groove 46 or the bore 40, or both.

Figure 9:
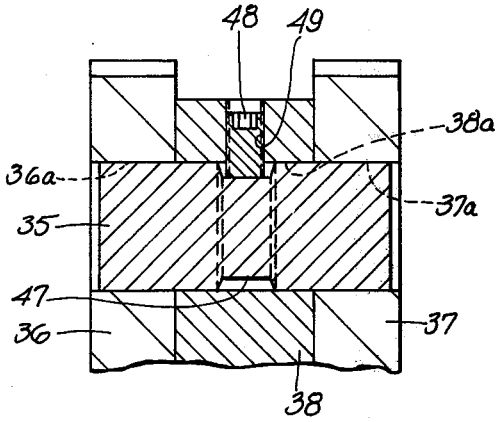
FIG. 9 is a section taken on the line 9—9 of FIG. 8.
Figure 17:
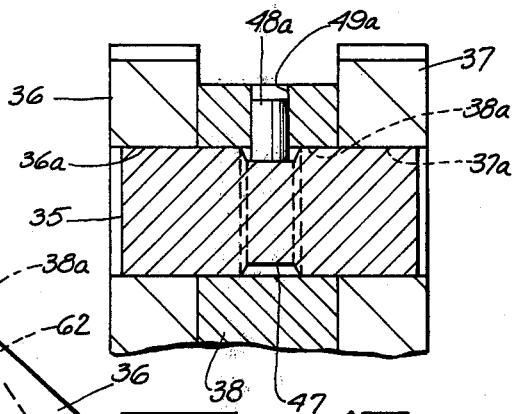
FIG. 17 is a view similar to that of FIG. 9 but showing the use of a short pin or plunger in place of the set screw arrangement.

FIGS. 8 and 9 depict yet another embodiment of the invention. The base member and bit holder are like those described in connection with FIGS. 1, 2, 5 and 6 and, therefore, like reference numerals will again be employed to designate like parts. In this arrangement of FIGS. 8 and 9 the connecting pin 35 is again provided with an annular groove which has been assigned the reference numeral 47. This groove 47 differs from that indicated at 46 in the embodiment of FIGS. 6 and 7 in that it is provided with a relatively flat bottom. This is so that it may be securely engaged by a set screw 48 which may be threaded into the bit holder portion 38 as indicated at 49. It is also possible, however, to eliminate the set screw and threaded hole and use in their stead a short pin or plunger 48*a* having a press or interference fit within a suitable orifice 49*a*, see FIG. 17. In this arrangement the bit holder 32 is inserted between the upstanding bifurcations 36 and 37 of the base member 31 and the connecting pin 35 is inserted in the aligned bores 36*a*, and 38*a* and 37*a* so as to bring the annular groove 37 into alignment with the orifice 49 or 49*a* for the set screw 48 or plunger 48*a* respectively. The set screw or plunger is then made to engage with the groove 47 and the connecting pin 35 is thus held within the aligned bores. When it becomes time to remove the connecting pin 35, the set screw 48 is simply backed out of the groove 47, or the short pin or plunger 48*a* is removed therefrom, and the connecting pin 35 driven from the assembled base member 31 and bit holder 32.

Figure 12:
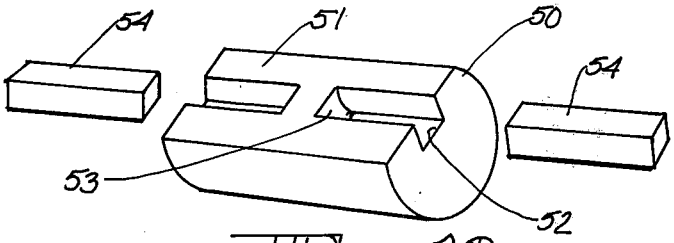
FIG. 12 is an exploded perspective view of the modified connecting pin and retaining means therefore as utilized in the arrangement of FIGS. 10 and 11.
Figure 10:
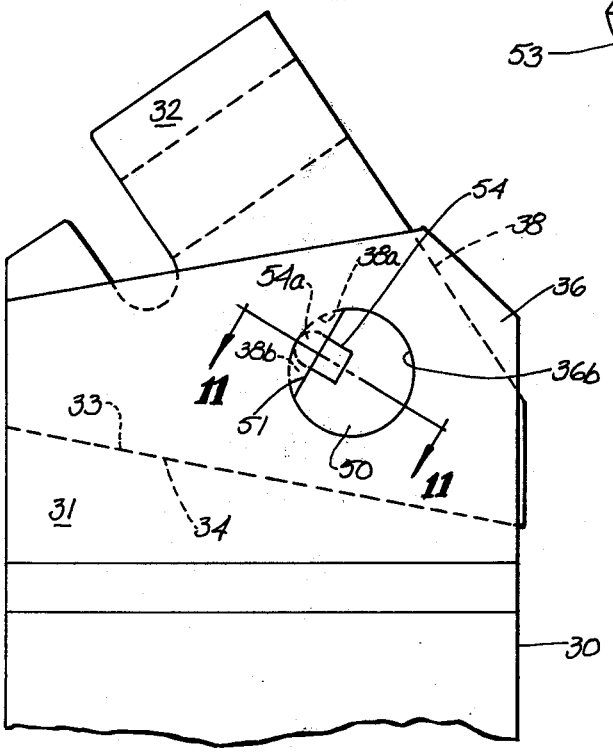
FIG. 10 is a side elevation of yet another embodiment of the retaining means for securing the connecting pin which joins the bit holder and base member.

A somewhat different version of the invention is illustrated in FIGS. 10, 11 and 12. In this arrangement the retaining pin or pins are located directly within the connecting pin itself. The modified base member and bit holder combination illustrated in these FIGS. are generally like those of FIGS. 1, 2, 5, 6, 8 and 9 and, therefore, like reference numerals will again be employed to designate like parts. Such members are, however, as indicated, modified to receive a different type of connecting pin and retaining means therefor, which latter pin and means are shown in FIG. 12. Reference is again made to U.S. Pat. Nos. 2,623,398; 2,766,979; 2,802,368 and 2,802,369 wherein similar means, but not similar combinations, are disclosed.

Because of the fairly significant difference in the shape of the connecting pin employed in the modification of FIGS. 10 through 12, such pin is designated generally at 50. The connecting pin 50, see particularly FIG. 12, is provided with a flat surface 51, thus giving it a generally D-shape when viewed in cross section. One or more grooves 52 are provided in the connecting pin 50 and extend from the ends thereof toward the center, each such groove 52 extending to the flat 51 and terminating inwardly at a cam surface 53. A retaining pin 54 is provided and is of such a size as to be just nicely received within its respective groove 52.

The bifurcations 36 and 37 are provided with D-shaped bores 36*b* and 37*b* which are of a shape to just nicely receive the modified connecting pin 50. The modified bores 36*b* and 37*b*, therefore, have the same cross sectional configuration as does the modified connecting pin 50, as is clearly shown in FIG. 10. The bore 38*a* of the bit holder portion 38, however, will be of circular cross section like that illustrated in the other FIGS.

In the modification of the invention as depicted in these FIGS. 10 through 12, the bit holder portion 38 is inserted between the upstanding bifurcations 36 and 37 of the base member 31 so that the abutment surfaces 33 and 34 are engaged and so that the bores 36*b*, 38*a* and 37*b* are aligned. The D-shaped connecting pin 50 is then inserted within these aligned bores. One or more of the pins 54 is then driven through a groove 52 so as to engage a cam surface 53. Upon engagement of the pin 54 with the cam surface 53, continued driving of the pin 54 will cause it to be deformed as at 54*a* by the cam surface 53 and to be directed away from the flat 51 and into the locking area 38*b* provided by the excess of circular bore 38*a* as compared to the D-shaped connecting pin 50 which passes therethrough. These projectios 54*a* extending into the bore 38*a* (locking area 38*b*) will retain the connecting pin 50 within the aligned bores 36*b*, 38*a* and 37*b*. When it becomes necessary to remove the connecting pin 50 so as to replace the bit holder 32, sufficient force applied axially of the connecting pin 50 will shear the retaining pin projections 54*a* whereby to permit complete removal of the connecting pin 50.

Figure 15:
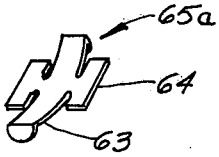
FIG. 15 is a perspective view of an exemplary retaining means suitable for use with the connecting pin of FIG. 14 in the combination of FIG. 16.
Figure 16:
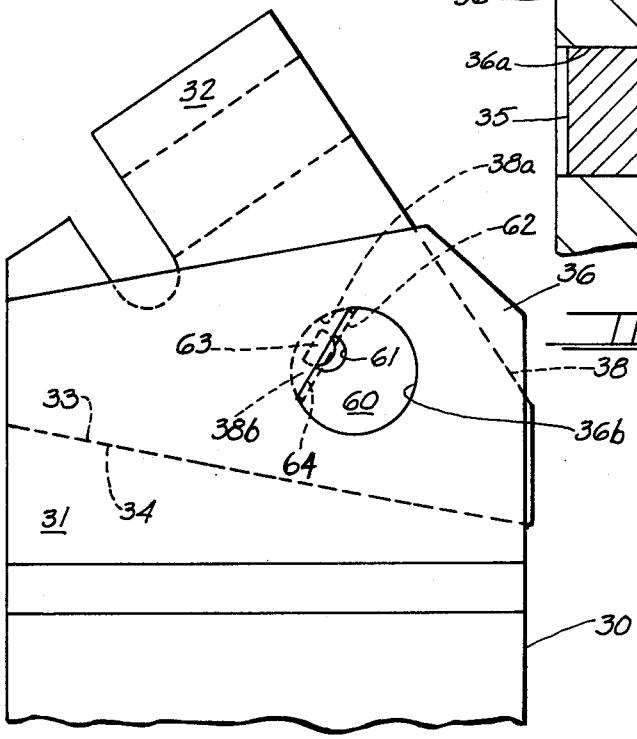
FIG. 16 is a view similar to FIG. 10 but depicting the combination of a bit holder and base member modified so as to utilize the exemplary modified connecting pin and retaining means therefore of FIGS. 14 and 15.

FIGS. 14 through 16 depict another modified bit holder and base member combination designed for use with connecting pins and connecting pin retaining means of the general type described in connection with FIGS. 10 through 12 in that the retaining means for the connecting pin are again incorporated rather directly with the connecting pin, and in that a generally D-shaped connecting pin is employed. Reference is again made to U.S. Pat. Nos. 2,741,139 and 2,826,085. In many respects, however, the modified base member and bit holder combination is much like that of FIGS. 1, 2, 5, 6, 8, 9 and 10 and, therefore, like numerals are employed to designate like parts.

The D-shaped connecting pin 60 of FIG. 14 is provided with grooves and indentations 61 and 62 to receive portions 63 and 64 respectively of a deformable or resilient retainer 65*a*. When the combined D-shaped connecting pin 60 and retainer 65*a* are inserted within the aligned bores 36*b*, 38*a* and 37*b* (not shown in FIG. 16), the retainer portions 63 initially flex out of the way until such time that these portions 63 can spring into the locking area 38*b* created by the excess of bore 38*a* as compared to the D-shaped configuration of the connecting pin 60. This retains the connecting pin in that position wherein it securely joins the base member and bit holder. Such connecting pin 60 is removed by exerting sufficient pressure axially thereof to overcome the deformable portions 63.

It has heretofore been pointed out herein that the base member, bit holder and connecting pin arrangement of FIGS. 1, 2, 5, 6 and 8 through 11 is generally like that disclosed in FIGS. 1 through 10 of U.S. Pat. No. Re. 28,310 and various of the FIGS. of U.S. Pat. No. 3,397,012 (this is also true for the arrangement of FIGS. 13 and 16 of this application); that the base member, bit holder and connecting pin arrangement of FIG. 3 is generally like that of FIG. 13 of U.S. Pat. No. Re. 28,310 and various of the FIGS. of U.S. Pat. No. 2,965,365; and that the base member, bit holder and connecting pin arrangement of FIG. 4 is generally like that of FIGS. 11 and 14 of U.S. Pat. No. Re. 28,310 and various of the FIGS. of U.S. Pat. No. 3,519,309. In the arrangements of these earlier patents, however, the retaining means for the connecting pin was located exteriorly of the side faces of the combined base member and bit holder. In all of the arrangements of the instant invention, however, the retaining means for the connecting pin is so located as not to extend beyond such side faces. The respective connecting pins 35, 50, 60 and 65 of the instant invention are of a length to be received in the combined base member and bit holder interlocked portions without extending beyond the side faces thereof. The respective retaining means 41, 71, 41*a*, 48, 48*a*, 54*a* and 63, all engage their respective connecting pins within the regions of the combined base member and bit holder portions without having to extend from any face thereof.

Thus, in the arrangement of FIGS. 1 through 4 and 13 the retaining pin 41 (or 71) may be driven through the bore 40 (or 70) so as to be engaged within the connecting pin bore 39 (or 69) and so as not to extend beyond the front face of the bit holder portion 38 (or base member portion 68). Similarly the pins 41*a* may be driven into the bores 40 and corresponding bores 39 and/or grooves 46 as the case may be. Likewise the set screw 48 or plunger 48*a* may be of such a size as to be completely within the confines of the bit holder portion 38 when one or the other engages the bottom of the groove 47 provided in the connecting pin 35. And finally, the retaining means 54 or 65*a* employed in the modifications of FIGS. 10 through 12 or of FIGS. 14 through 16 will be of such a size as to be, when so driven as to have the deformed portions 54*a* or 63 thereof project into the locking area 38*b* provided by the bore 38*a*, completely contained within the bores 36*b* and/or 37*b*.

This invention is directed to bit holder and base member combinations and to the various included means and arrangements for retaining the connecting pins as a part of such bit holder and base member combinations. It is not directed to specific bit holders or bits. The many prior art patents disclosing such bit holders and bits, and referred to herein, have been mentioned by way of example only, to emphazize the many application to which this invention may be put.

It is believed that the foregoing constitutes a complete and accurate description of the invention. It will be understood by those skilled in the art that modifications may be made in this invention without departing from the scope and spirit thereof. It should also be understood that while the invention has been described in terms of particular structures and arrangements, such structures and arrangements are not to constitute a limitation on the invention except insofar as they are specifically set forth in the subjoined claims.

Having this described the invention, what is claimed as new and what is desired to be protected by Letters Patent is:

1. In a mining machine and the like having at least one driven element adapted to advance a cutter bit assembly in a cutting direction, said assembly comprising a base member affixed to said driven element, a bit holder, and a connecting pin located within aligned holes in said base member and said bit holder whereby to join said bit holder to said base member, the joined bit holder and bit member having cooperating abutment surfaces to sustain some of the resultant cutting forces encountered during mining operations, the improvement which comprises: said connecting pin being located wholly within the joined bit holder and base member; a retaining pin for said connecting pin to retain said connecting pin within said joined bit holder and base member; and structure to permit insertion of said retaining pin into said connecting pin after said connecting pin has been located within said joined bit holder and base member; said retaining pin also being located wholly within the confines of said joined bit holder and base member, said retaining pin being specifically located completely within said connecting pin and said bit holder free of said base member.

2. The structure of claim 1 including a first bore in said bit holder, said first bore extending at least to said connecting pin, a second bore in said connecting pin, and said retaining pin being located partly within said first bore and partly within said second bore.

3. The structure of claim 2 in which said second bore extends completely through said connecting pin, said retaining pin being of a length less than the diameter of said connecting pin, whereby said connecting pin may be removed from said joined bit holder and base member by first forcing said retaining pin completely out of said first bore into said second bore within the confines of said connecting pin, and then driving said connecting pin from said joined bit holder and base member.

4. The structure of claim 2 in which said bit holder is provided with a shank receiving perforation to receive the shank of a bit, and in which said first bore extends through said bit holder to said perforation, and said second bore extends completely through said connecting pin, whereby said connecting pin may be removed from said bit holder and base member by driving said retaining pin through said first and said second bores to said perforation.

5. The structure of claim 2 in which said first bore extends completely through said bit holder, and said second bore extends completely through said connecting pin, whereby said connecting pin may be removed from said joined bit holder and base member by driving said retaining pin completely out of said first and said second bores.

6. The structure of claim 5 in which said retaining pin is of a length greater than the diameter of said connecting pin, whereby in said joined bit holder and base member said retaining pin may protrude from both ends of said second bore.

7. The structure of claim 1 including a first bore in said bit holder, said first bore extending at least to said connecting pin, an annular groove in said connecting pin, and said retaining pin being positioned partly in said first bore and partly in said groove.

8. The structure of claim 7 in which said first bore extends completely through said bit holder, whereby said retaining pin may be removed from said bit holder by driving said retaining pin completely out of said first bore and out of said groove.

9. The structure of claim 7 in which said retaining pin comprises a plunger having an interference fit in said first bore.

* * * * *

UNITED STATES PATENT AND TRADEMARK OFFICE

CERTIFICATE OF CORRECTION

PATENT NO. : 4,163,581

DATED : August 7, 1979

INVENTOR(S) : Claude B. Krekeler

It is certified that error appears in the above-identified patent and that said Letters Patent are hereby corrected as shown below:

In the fifth line of the ABSTRACT, "having" should be --have--;
In line 16 of Column 1 a comma has been omitted after the word "machines" (first occurance);
In line 21 of Column 8 the notation "projectios" should be --projections--; and
In line 65 of Column 9 (Claim 1.) the last word "bit" should be --base--.

Signed and Sealed this

*Thirteenth* Day of *November 1979*

[SEAL]

*Attest:*

RUTH C. MASON
*Attesting Officer*

LUTRELLE F. PARKER
*Acting Commissioner of Patents and Trademarks*